US011029112B2

(12) United States Patent
Weiss

(10) Patent No.: US 11,029,112 B2
(45) Date of Patent: Jun. 8, 2021

(54) HANDGUN SAFETY DEVICE AND METHOD

(71) Applicant: State of Israel, Prime Minister Office, Ramat Gan (IL)

(72) Inventor: Amir Weiss, Ramat Gan (IL)

(73) Assignee: STATE OF ISRAEL, PRIME MINISTER OFFICE

( * ) Notice: Subject to any disclaimer, the term of this patent is extended or adjusted under 35 U.S.C. 154(b) by 0 days.

(21) Appl. No.: 16/957,476

(22) PCT Filed: Nov. 18, 2018

(86) PCT No.: PCT/IL2018/051238
§ 371 (c)(1),
(2) Date: Jun. 24, 2020

(87) PCT Pub. No.: WO2019/130291
PCT Pub. Date: Jul. 4, 2019

(65) Prior Publication Data

US 2021/0071973 A1 Mar. 11, 2021

(30) Foreign Application Priority Data

Dec. 25, 2017 (IL) ..... 256577

(51) Int. Cl.
*F41A 17/44* (2006.01)
*F41A 17/00* (2006.01)
*F41C 27/00* (2006.01)

(52) U.S. Cl.
CPC ..... *F41A 17/44* (2013.01); *F41A 17/00* (2013.01); *F41C 27/00* (2013.01)

(58) Field of Classification Search
CPC ..... F41A 17/00; F41A 17/44; F41C 27/00
USPC ..... 42/70.11
See application file for complete search history.

(56) References Cited

U.S. PATENT DOCUMENTS 2,997,802 A * 8/1961 Robbins ..... F41A 17/44 42/70.11
3,018,576 A * 1/1962 Riechers ..... F41A 17/44 42/70.11
3,605,311 A * 9/1971 Hermann ..... F41A 17/44 42/70.11
4,054,002 A * 10/1977 Latona, Jr. ..... F41A 17/44 42/96
4,084,340 A * 4/1978 Scudder ..... F41A 17/44 42/96
4,833,811 A * 5/1989 Wilkinson ..... F41A 17/02 42/66
4,835,894 A * 6/1989 Libassi ..... F41A 17/44 42/70.11
4,896,447 A * 1/1990 Badoni ..... F41A 17/44 42/95
4,965,952 A * 10/1990 Miller ..... F41A 17/44 42/1.05
5,097,613 A * 3/1992 Miller ..... F41A 17/44 42/1.05

(Continued)

*Primary Examiner* — Joshua E Freeman
(74) *Attorney, Agent, or Firm* — Dorsey & Whitney / RCPs

(57) ABSTRACT

A handgun safety device comprising a safety element with a firing interrupting element configured for snug projection between a face of a duty cartridge and a fore end of a functional firing element, said safety element being articulated at a first end of a cord having a full length, with a second end configured for attaching to an article worn by a user.

18 Claims, 11 Drawing Sheets

(56) References Cited

U.S. PATENT DOCUMENTS

| | | | | | |
|---|---|---|---|---|---|
| 5,419,069 | A * | 5/1995 | Mumbleau | F41A 17/02 | 42/70.11 |
| 5,669,252 | A * | 9/1997 | Bentley | F41A 17/44 | 42/70.04 |
| 6,250,008 | B1 * | 6/2001 | Silver | F41A 17/44 | 42/70.01 |
| 6,470,615 | B1 * | 10/2002 | Peterken | F41A 17/44 | 42/70.01 |
| 6,591,532 | B1 * | 7/2003 | Gilbertson | F41A 17/42 | 42/70.11 |
| 6,785,994 | B2 * | 9/2004 | Christiansen | F41A 17/44 | 42/1.01 |
| D631,123 | S * | 1/2011 | Byers | D22/108 | |
| D701,282 | S * | 3/2014 | Ferguson, II | D22/108 | |
| 8,850,738 | B2 * | 10/2014 | Silver | F41C 27/00 | 42/108 |
| D779,016 | S * | 2/2017 | Rumpke | D22/108 | |
| 9,810,499 | B1 * | 11/2017 | Silver | F41A 17/44 | |
| D827,761 | S * | 9/2018 | Rumpke | D22/108 | |
| 2013/0180152 | A1 * | 7/2013 | Speroni | F41G 1/35 | 42/99 |
| 2014/0237877 | A1 * | 8/2014 | Silver | F41A 17/44 | 42/70.11 |
| 2014/0325889 | A1 * | 11/2014 | Michal | F41G 11/003 | 42/75.01 |

* cited by examiner

HANDGUN SAFETY DEVICE AND METHOD

TECHNOLOGICAL FIELD

The present disclosure is concerned with handgun safety, and more particularly with a device and method for increasing safety of handgun users, for reducing self-accident injuries.

BACKGROUND ART

References considered to be relevant as background to the presently disclosed subject matter are listed below:

U.S. Pat. No. 4,835,894

U.S. Pat. No. 6,250,008

Acknowledgement of the above references herein is not to be inferred as meaning that these are in any way relevant to the patentability of the presently disclosed subject matter.

BACKGROUND

U.S. Pat. No. 4,835,894 discloses a safety plug device for the firing chambers of firearms such as pistols and rifles wherein the safety plug device comprises a stepped shoulder generally cylindrical plug member having a tab member with an enlarged flag portion formed on its upper end; wherein, the plug member and a portion of the tab member are dimensioned to be received in the firing chamber while flag portion will project a substantial distance above the slide bolt mechanism of the firearms to indicate that the weapon is unloaded.

U.S. Pat. No. 6,250,008 discloses a safety plug for the firing chamber of a firearm provides a visual indication of its presence within the firing chamber (thereby preventing accidental discharges). The safety plug is shaped similar to an ammunition cartridge commonly used in the firearm. A tab extends outwardly from the safety plug through the breech to provide visible confirmation of its presence in the firing chamber. The tab includes a luminescent element to enhance visual confirmation in low light conditions. A beveled rim is engaged by an extractor to remove the safety plug from the firing chamber without catching on a top round of ammunition loaded in the firearm's magazine. An annular lip and a collet are formed at the forward end of the safety plug for use in certain types of firearms, such as a pump-action shotgun, to prevent the safety plug from falling out of the firing chamber or jamming.

A dangerous and one of the most common issues that faces firearm carriers is the so-called 'negligent discharge' at times also referred to as 'accidental discharge' or 'Unintentional discharge', though these terms may sometimes have different interpolations. Here in after in the specification and claims the term negligent discharge is collectively used to describe mishaps usually caused by drawing (or trying to holster) a handgun with the user's finger on the trigger.

One of the most important gun safety rules is that one's finger should remain outside the trigger guard until the decision has been made to fire the weapon and only when pointed towards a target (either practice target or a hostile target), and likewise, one's finger should be out of the trigger guard while holstering. Following these rules ensures that, should an accidental discharge occur, no harm will be done.

However, often individuals carry their handgun in a loaded position, i.e. with a fresh round of ammunition ('live ammunition') resident in the chamber/cylinder. This is a common standby/carrying position and also used in fast/quick-draw training.

The term handgun, as used herein the specification and claims denotes a variety of handguns including pistols (striker-type firing and hammer-type firing) and revolvers, single or double action, all intended to be held and fired using one hand.

General Description

According to the present disclosure there is provided a handgun safety device comprising a safety element with a firing interrupting element configured for snug projection between a face of a duty cartridge and a fore-end of a functional firing element, said safety element being articulated at a first end of a cord having a full length, with a second end configured for attaching to an article worn by a user.

The term duty cartridge, as used herein the specification and claims, refers to a cartridge (round of ammunition) received in the chamber of the barrel (pistols), or in the cylinder (revolvers), opposite the firing pin, ready to be fired.

The term face of a duty cartridge, as used herein the specification and claims, refers to the rear face of the rim of the duty cartridge, where the primer is located.

The term functional firing element, as used herein the specification and claims, is an element of the handgun taking part in a firing sequence, and can be different elements depending on the handgun type:

- In a pistol the functional firing element can be a breach face (through which the striker projects);
- In a revolver the functional firing element can be a striking face of a hammer.

The term full length, as used herein in the specification and claims, is defined as the length of the cord at its fully extended/starched out position, i.e. its maximal length.

The term article worn by a user, denotes any article worn by, attached to or carried by the user, such as a holster (waist, drop leg/thigh, etc.), a belt, a pants buckle, suspenders, a bag/pouch/purse, and the like.

In use, as long as the firing interrupting element is disposed at an interrupting positon, between the face of the duty cartridge and the functional firing element, it obstructs a firing mechanism of the handgun, so that a round cannot be fired even at the event that the trigger is pulled.

The arrangement is such that drawing the handgun when the safety element is positioned with the firing interrupting element at in interrupting positon and with the second end attached to the article worn by the user, results in extending of the cord to substantially its full length, with further motion resulting in detaching of the safety element from the handgun, thereby enabling full contact and complete locking of the fire mechanism of the handgun, such that pulling the trigger will result in firing a round. Thus, the safety element facilitates drawing the handgun and firing a live round without having to cock the handgun or take any other action, as the safety element will spontaneously detach from the handgun when the cord has reached its full length.

According to another aspect of the present disclosure, there is disclosed a method for using a handgun, the method comprises the following steps:

a) Obtaining a handgun safety device comprising a safety element with a firing interrupting element configured for snug projection between a face of a duty cartridge and a fore end of a functional firing element, said safety element being articulated at a first end of a cord having a full length, with a second end configured for attaching to an article worn by a user;

b) Attaching the second end to an article worn by a user;

c) Before or after b) at least partially cocking the handgun so as to give rise to a space between the face of a duty cartridge and a fore end of a functional firing element;

d) Placing the safety element with the firing interrupting element at an interrupting positon; and e) Releasing the handgun from the at least partially cocked position.

For the purpose of at least partially cocking the handgun, in case of a pistol, a user can cock the slide until it becomes arrested by the slide stop.

Any one or more of the following features, design and configurations can be applied to a handgun safety device and a method according to the present disclosure, separately or in various combinations thereof:

The second end can be configured with a fixed or a detachable attaching member, for fixedly or removably attaching to the article worn by a user;

The attaching member can be a buckle, a clip, a band, a snap fastener, a hook and pile fitting, an elastic band, etc.;

The attaching member can be fixedly or detachably secured to the second end of the cord;

At a carrying position, when the handgun is near the article worn by the user w the cord is loos, at a slack position, however the cord reaches its full length upon drawing and as the handgun is removed from the article worn by a user;

The handgun safety device can be used with the handgun loaded with ammunition, i.e. with a round resident in the chamber (in case of a pistol) or in the cylinder (in case of a revolver);

The handgun safety device can be used with the handgun loaded with a magazine;

The cord is configured to reach the full length upon drawing the handgun and reaching an angle of between about 15 to 55 degrees, measured with respect to an imaginary vertical line;

The full length of the cord is between about 20 to 60 cm.;

The cord can be associated with a cord retractor member;

The cord can be made of, or comprises, a reinforced core material, e.g. metal or other tear/wear resistant material;

The cord can be coated with a protective layer;

At least a portion of the cord can be coiled, so as to impart said at least portion with elastic properties;

At least a portion of the cord can be elastic;

The cord can be articulated to the safety element at a location coaxial with longitudinal axis thereof;

The cord can be articulated to the safety element at a location offset from a longitudinal axis thereof, resulting in a tilting moment generated upon tensioning of the cord;

The safety element can be configured for lefthand or righthand users, wherein the safety element can comprise indicia representing weather the device is Left hand or right hand;

The cord can be articulated to a rear end portion of the safety element;

The length of the cord can be adjusted for adapting it to various articles worn by the user and to physiological parameters of an individual (e.g. arm length, etc.);

The safety element can further comprise an attachment arrangement for attaching it to the handgun, however readily detachable;

The attachment arrangement can be a magnet;

The attachment arrangement can be a hook and pile fastener;

The safety element can be colored, e.g. by glowing colors;

The safety element (e.g. the body portion thereof) can comprise a light emitting element, for providing different indications;

The safety element can be made of acrylic material to eliminate or substantially reduce any damage to components of the handgun;

In case of a pistol, the firing interrupting element prevents complete locking of the weapon whereby incomplete locking displacement of a slide of the handgun breaks contact between the trigger assembly and the striker assembly, i.e. preventing the breach from locking;

The firing interrupting element is shaped and sized for insertion at a recess formed at an ejector port of the handgun, with a first face portion of the firing interrupting element bearing against a breach face of the slide, and an opposite, second face portion of the face of the firing interrupting element bearing against a rear face of a duty cartridge received in the barrel chamber;

Where the handgun is a revolver, the firing interrupting element can be configured for insertion in between a face of a duty cartridge and a hammer, or between a rear end of a striker pin and a hammer, or between a face of a duty cartridge and a fore end of a firing pin;

The firing interrupting element can project from an outside surface of the handgun slide through an ejection port opening;

The safety element can have an L-like cross section, where a long arm segment is configured for externally bearing over a portion of the handgun, and a short arm segment is the firing interrupting element;

The short arm segment constitutes the firing interrupting element.

According to a particular example the firing interrupting element is substantial rectangular;

According to one particular example the firing interrupting element is about 5 mm thick (as measured in the axial direction, i.e. in the line of action parallel to the longitudinal axis and substantially parallel to the barrel of the handgun); said firing interrupting element being about 8 mm long (i.e. depth of extension from a bottom face of the safety element), and having a width of about 5 mm The firing interrupting element is shaped and sized for fitting at least partially within a cutout at a rear side of an ejection port; said cutout extending flush over a breach face of the handgun;

The safety device can be used also when applied to a handgun received in a partially open holster

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
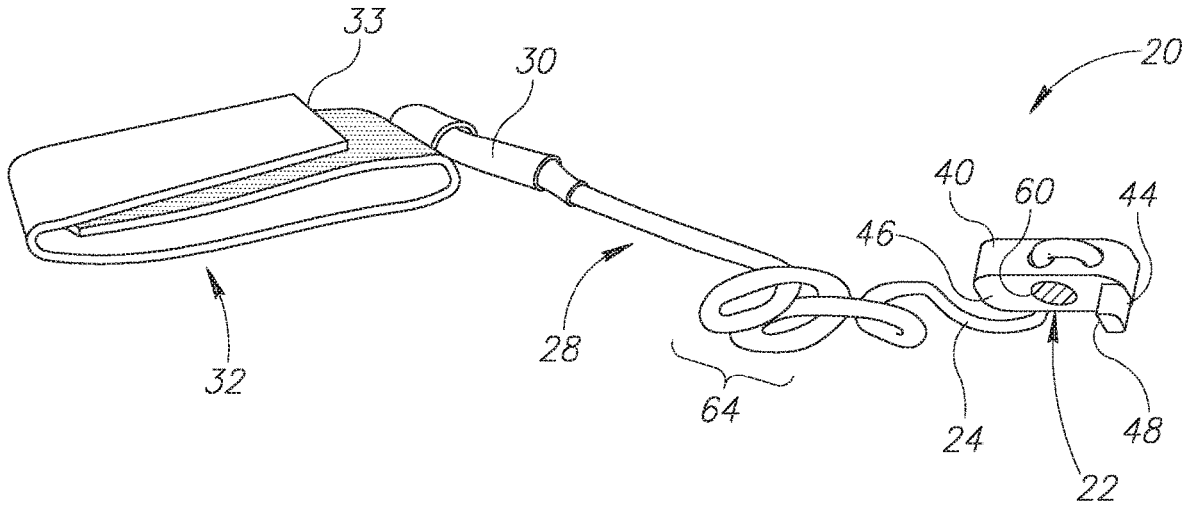
FIG. 1A is a perspective view of a safety element according to an example of the present disclosure.
Figure 1B:
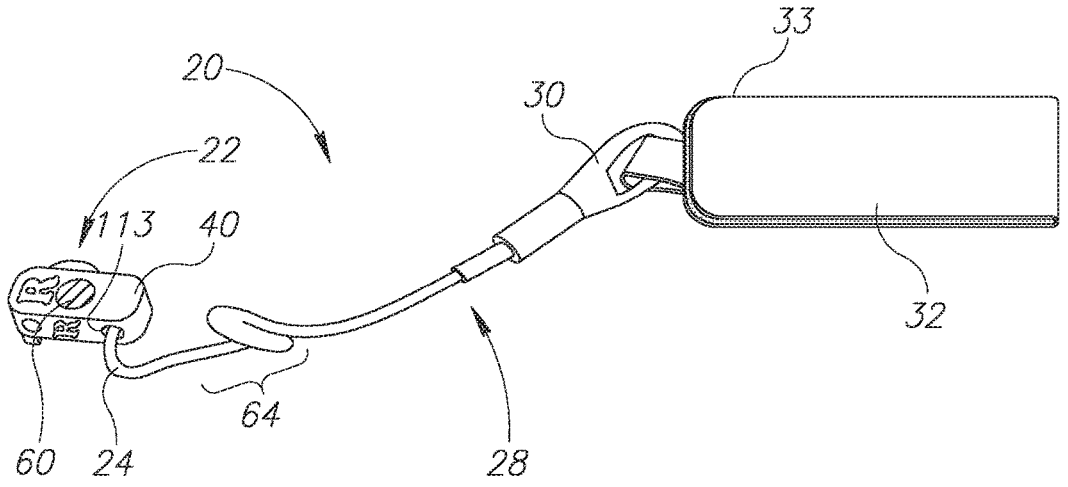
FIG. 1B is a different perspective view of the safety element of FIG. 1A.

Attention is first directed to FIGS. 1A and 1B illustrating a handgun safety device according to the disclosure, generally designated 20, comprising a safety element 22 articulated to a first end 24 of a cord 28, with a second end 30 of the cord 28 articulated to an attaching member 32, configured for attaching to an article worn by a user as will be described herein after.

Figure 2B:
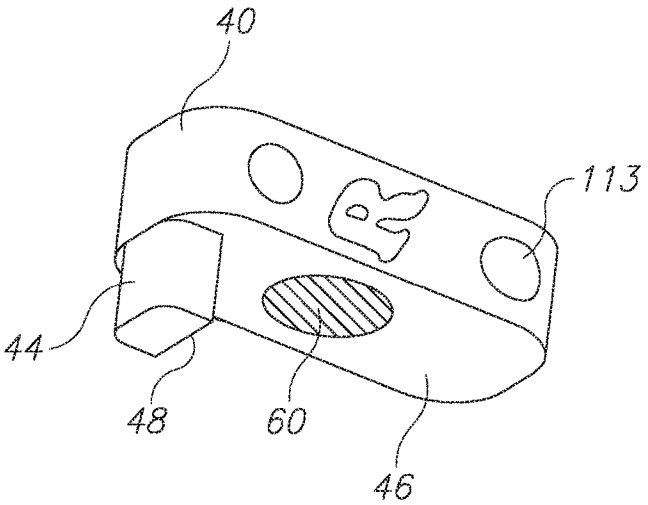
FIG. 2B is a bottom right perspective view of the firing interrupting element of FIG. 2A.
Figure 2A:
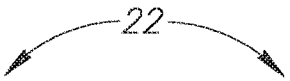
FIG. 2A is a bottom left perspective view of a firing interrupting element of the safety element of FIG. 1.
Figure 4:
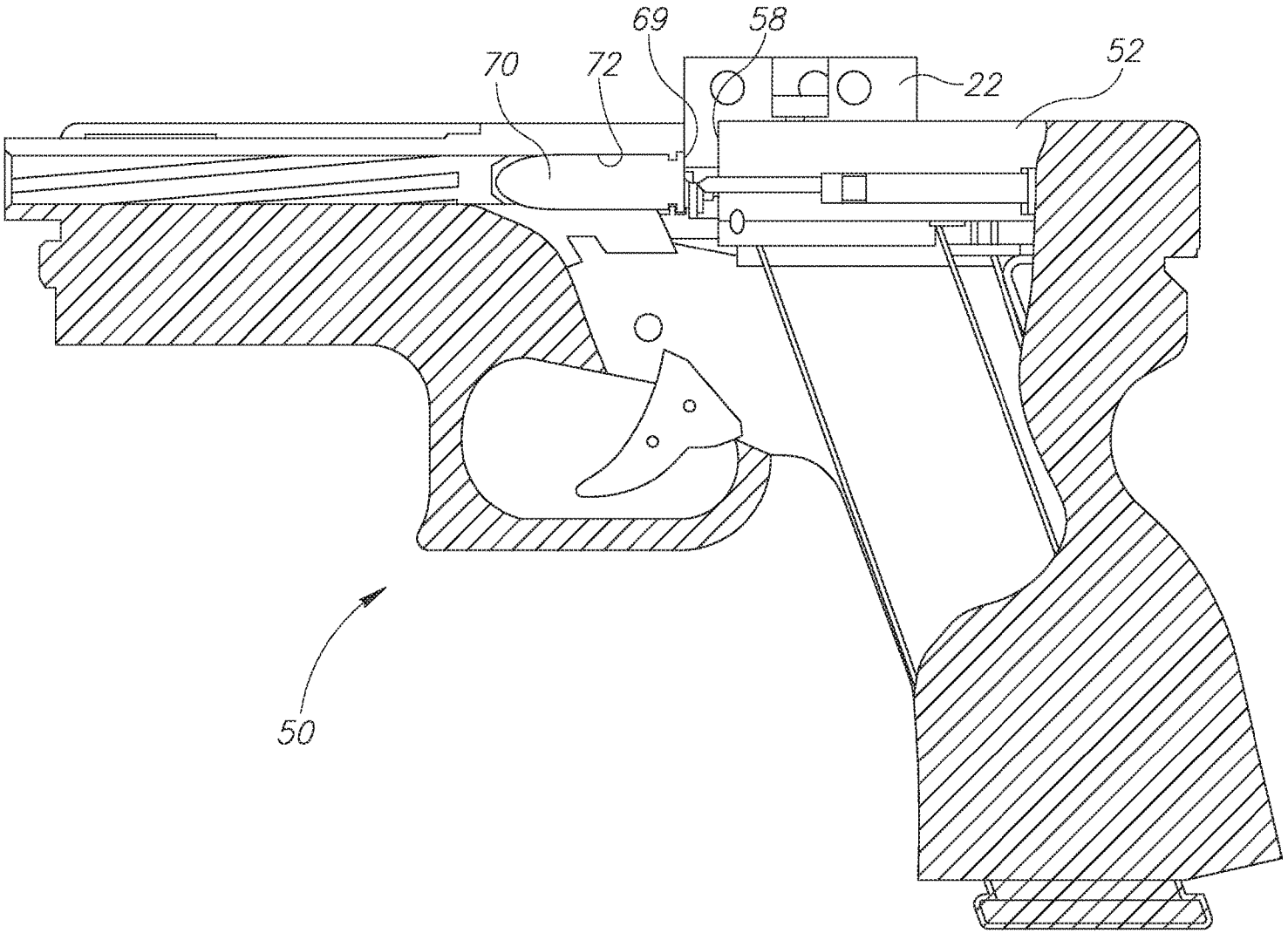
FIG. 4 is a side view of a striker type pistol, with a local cutout illustrating positioning of a handgun safety device according to the disclosure.
Figure 7B:
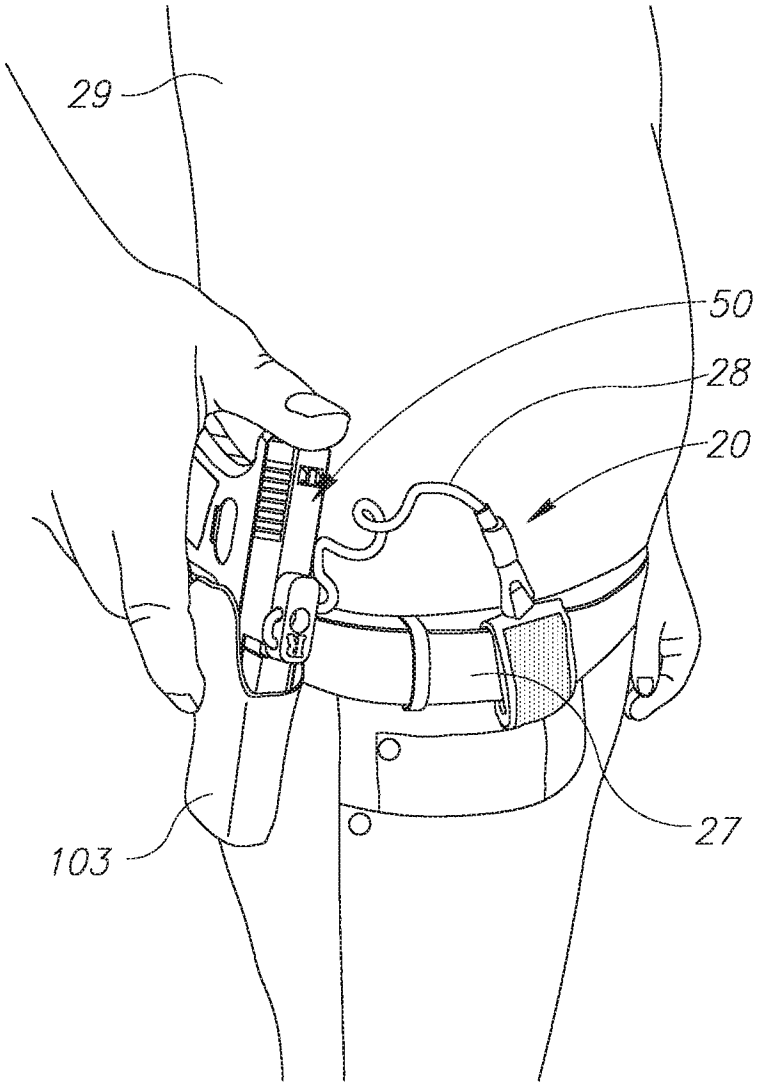
FIGS. 7A and 7B illustrate consecutive steps of introducing the pistol of FIG. 6 into a holster.

The safety element 22, seen in greater detail in FIGS. 2A and 2B, comprises a body portion 40 with a firing interrupting element 44 projecting therefrom, whereby the safety element 22 assumes a generally L-like shape with the firing interrupting element 44 constituting a short arm and the body portion 40 constituting the long arm. The size and shape of the safety element 22 and likewise the parameters of the firing interrupting element 44 can be adapted so as to match different handguns, i.e. to conform with the shape and firing mechanism of the weapon concerned. In the illustrated example the safety element 22 is configured for use in conjunction with a striker-type firing pistol, and more specifically with a Glock™ 19 pistol (50 in FIG. 7). Thus, it can be seen that the body portion 40 is configured with a flat bottom face 46 suited for resting flush over the slide 52 of the handgun 50, as will be discussed hereinafter in greater detail. Likewise, the shape and size of the firing interrupting element 44 is such so as to partially fit within a cutout 54 formed at a rear side of an ejection port 56 of the slide of the handgun 50, such that when mounted, face 48 of the firing interrupting element 44 bares flush over a breach face 58 of the handgun (FIGS. 4 and 7B).

The safety element 22 is further configured with an attachment arrangement, namely a magnet 60, for magnetically attracting/attaching the safety element 22 and securing it in position, however readily and easily detachable. It is appreciated that the attachment arrangement can be a hook and pile couple or other attachment means, however readily and easily detachable.

In the present example, the cord 28 is a reinforced rubber coated cord (similar to a pistol safety lanyard with coiled bungee portion), with a coiled portion 64 imparting it elastic properties and spontaneous contraction/retraction so that it has a full length (e.g. FIG. 9E) and a retracted/contracted length. According to one particular example, the full length of the cord is about 24 cm. and the contracted length is about 10 cm.

Figure 3:
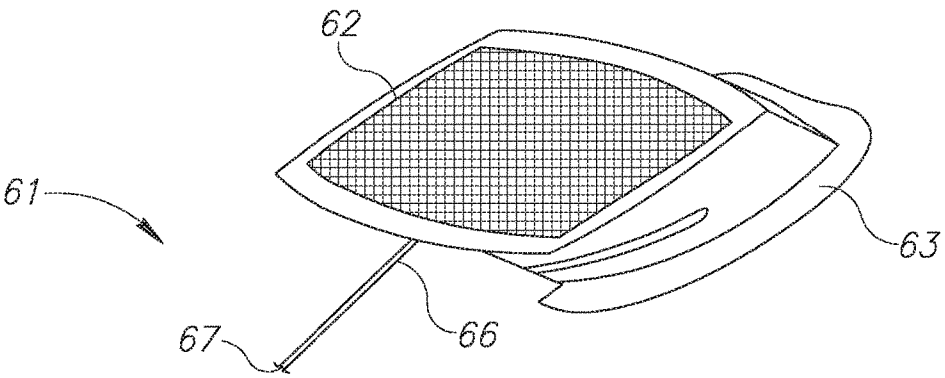
FIG. 3 is an example of a cord retractor member useful in conjunction with a safety element according to the disclosure.

However, it should be appreciated that the cord 28 can be a regular cord, i.e. devoid of any contraction arrangement, or it can be fully coiled so as to increase the ration between the full length and the retracted/contracted length, or it can be associated with a retraction mechanism 61 as illustrated by way of example in FIG. 3. The retraction mechanism 61 is of generally known structure and comprises a housing 62 fitted with a belt mount 63 (i.e. attaching member, configured for attaching to an article worn by a user, so as to constitute said second end of the cord). And a spring loaded cord rewinding mechanism (not seen) within the housing 62 for retracting the cord 66 and retaining it at a retracted positon, with a first end 67 of the cord attachable to the safety element (not shown in FIG. 3). It should also be appreciated that the attaching member can be a buckle, a clip, a band, a snap fastener, a hook and pile fitting, an elastic band, etc.

In the illustrated example the attaching member 32 is a flexible belt loop with a hook and pile fastener 33 configured for attaching to a variety of articles worn by a user, such as a holster (waist, drop leg/thigh, etc.), a belt, a pants buckle, suspenders, a bag/pouch/purse, and the like. However, it is noted that the attaching member can be configured as a buckle, a clip, a band, a snap fastener, a hook and pile fitting, an elastic band, etc., facilitating easy attaching and removal thereof.

Reverting now to the firing interrupting element 44, the arrangement is such that when the safety element 22 is applied to the handgun (different examples illustrated hereinafter), the firing interrupting element 44 is disposed at an interrupting positon, namely between the rear face 69 of a duty cartridge 70 (FIG. 4) received in the chamber 72 and the functional firing element (i.e. firing/striker pin or breach face 58), it obstructs a firing mechanism of the handgun, so that a round cannot be fired even at the event that the trigger is pulled. In many particular cases, the firing interrupting element 44 constitutes an obstruction, thereby preventing complete locking of the handgun, whereby incomplete locking displacement of a slide of the handgun breaks contact between the trigger assembly and the striker assembly, i.e. preventing the breach from locking and preventing firing the handgun even at the event that the trigger is pulled.

Figure 5:
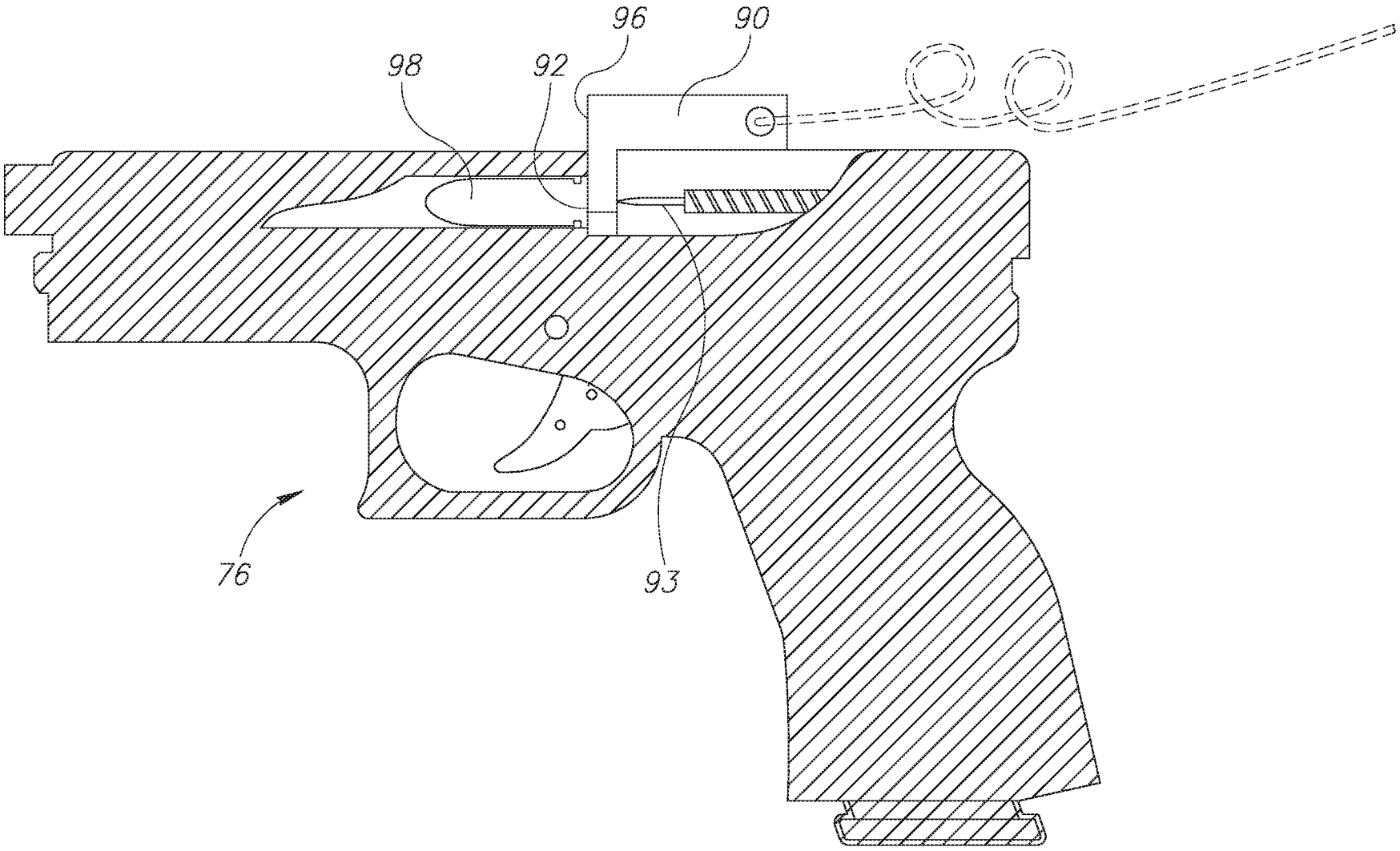
FIG. 5 is a side view of a hammer firing pistol, with a local cutout illustrating positioning of a handgun safety device according to the disclosure.

Whilst the example of FIG. 4 refers to a striker-type pistol 50, in FIG. 5 there is illustrated a hammer-type pistol generally designated 76 wherein the safety element 90 (cord partially illustrated in dashed lines for sake of clarity) is similar to the safety element 22 of the previous example, however with the firing interrupting element 92 extending longer, such that when applied over the pistol 76, it not only prevents complete locking of the firing mechanism, but rather it also extends in the line of operation of firing pin 93, behind the rear face 96 of the duty cartridge 98. Thus, even at the event of pulling the trigger, the pistol 76 will not fire, as long as the safety element 90 is at the obstructing position.

Figure 6A:
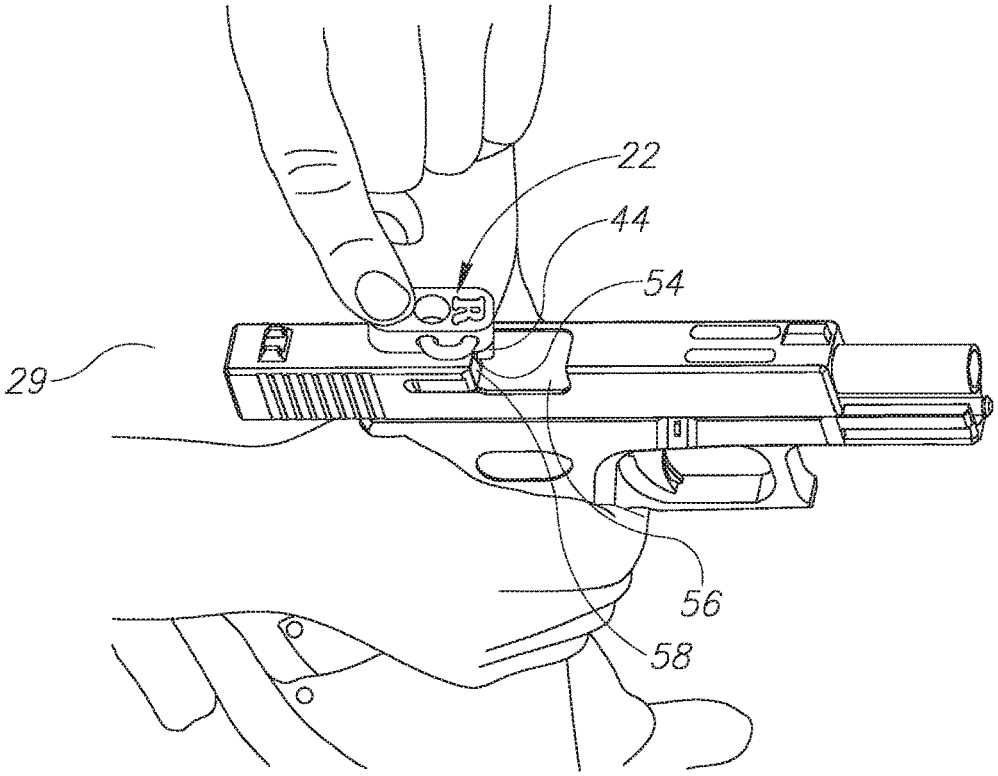
FIG. 6A illustrates a cocked pistol, with the slide arrested by the slide stop and the handgun safety device positioned in place.
Figure 6B:
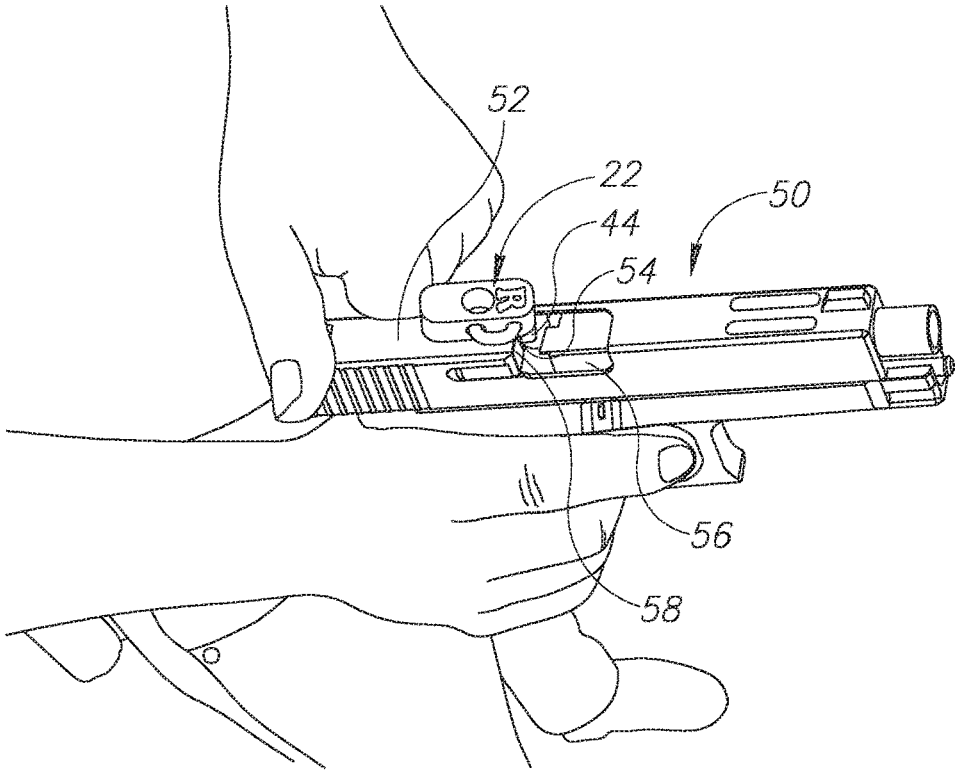
FIG. 6B illustrates releasing the slide into a standby position, with a live round of ammunition in the barrel chamber.
Figure 7A:
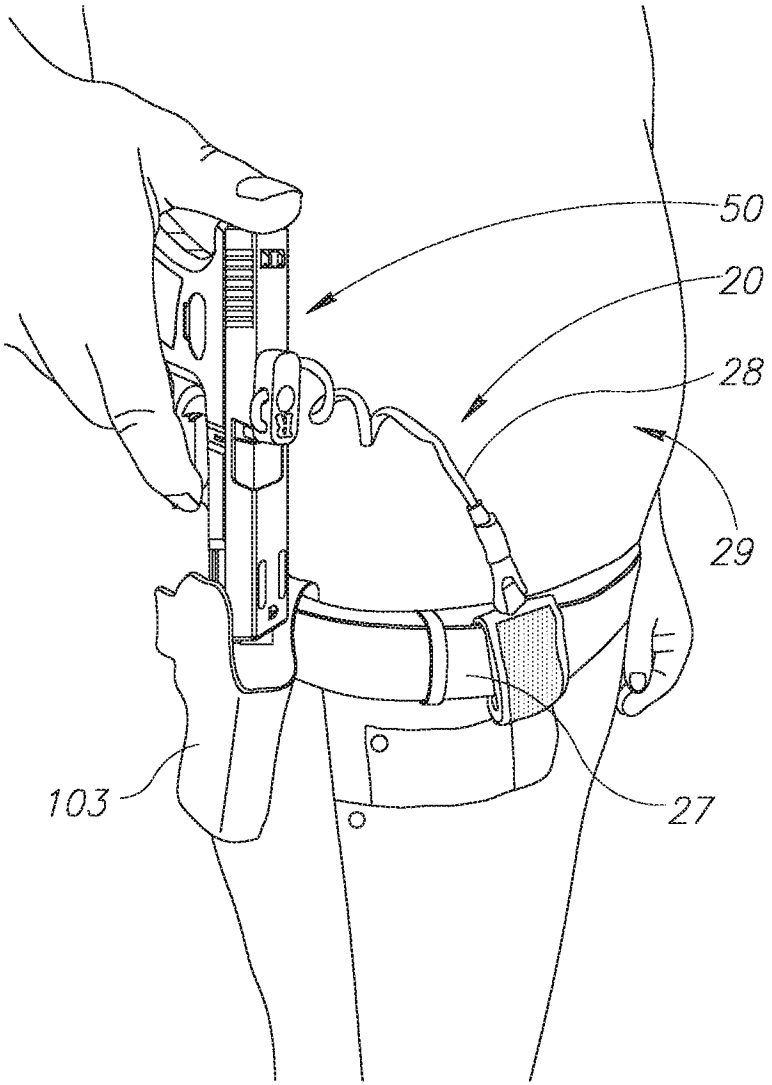

Further attention is now being made to FIGS. 6 and 7. A method using the handgun safety device comprises the steps of:

- Obtaining a handgun safety device 20 according to present disclosure, as discussed herein;
- Attaching the second end 30 of cord 28 to a belt 27 (article worn by a user 29) by the attaching member 32 (noted that the article worn by a user can just as well be the holster 103 seen in FIG. 7);
- at least partially cocking the handgun 50 so as to give rise to a space between the face 69 of a duty cartridge 70 and a fore end of a functional firing element (breach face 58; FIG. 4); this step can take place also earlier;

Placing the safety element 22 with the firing interrupting element 44 at an interrupting positon (FIG. 6A); and Releasing the handgun 50 from the at least partially cocked position (FIG. 6B).

For the purpose of at least partially cocking the handgun 50, a user can cock the slide until it becomes arrested by the slide stop, as known in the art.

It is realized that a magazine can be introduced into the pistol before or after cocking the handgun.

Figure 8B:
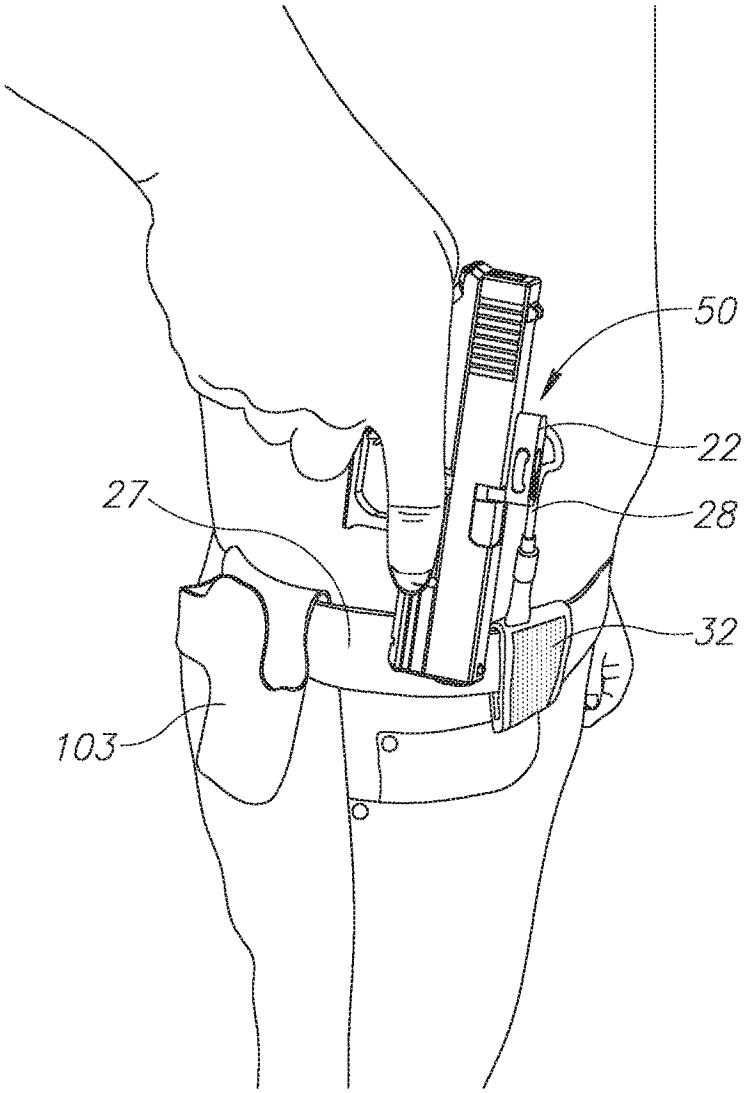
FIGS. 8A to 8I illustrate consecutive steps of fast drawing the pistol of FIGS. 6 and 7, illustrating detachment of the safety element and discharging a round of ammunition.
Figure 8A:
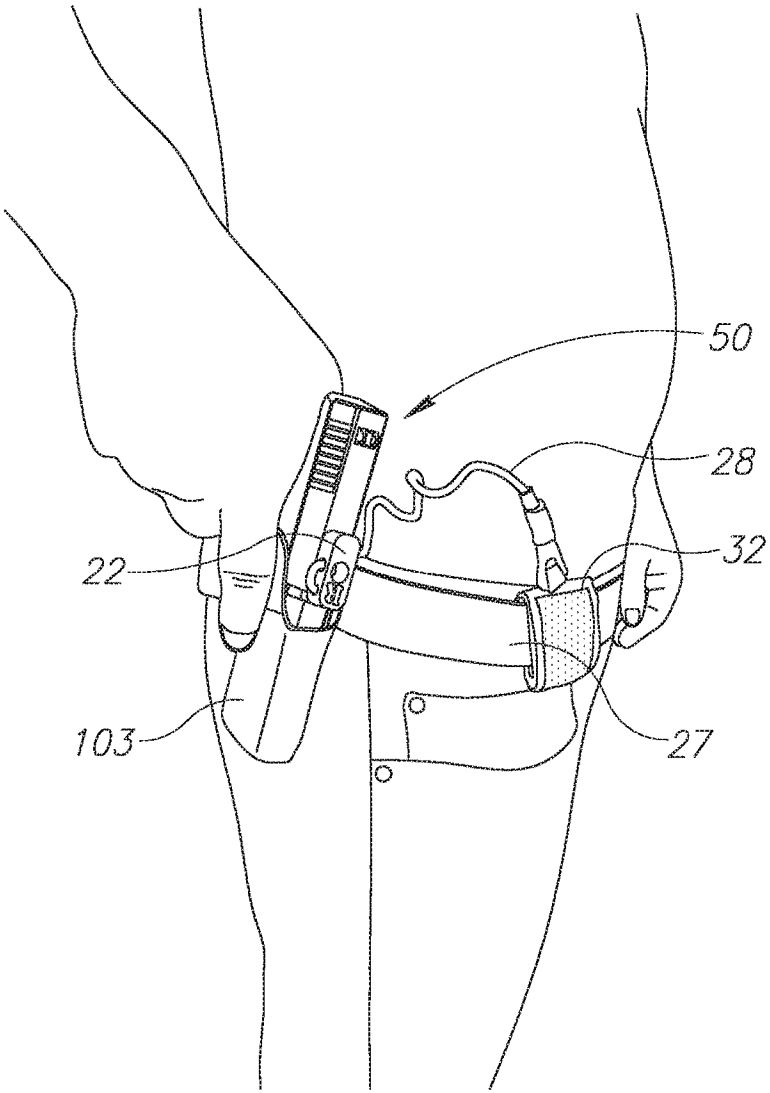
Figure 8D:
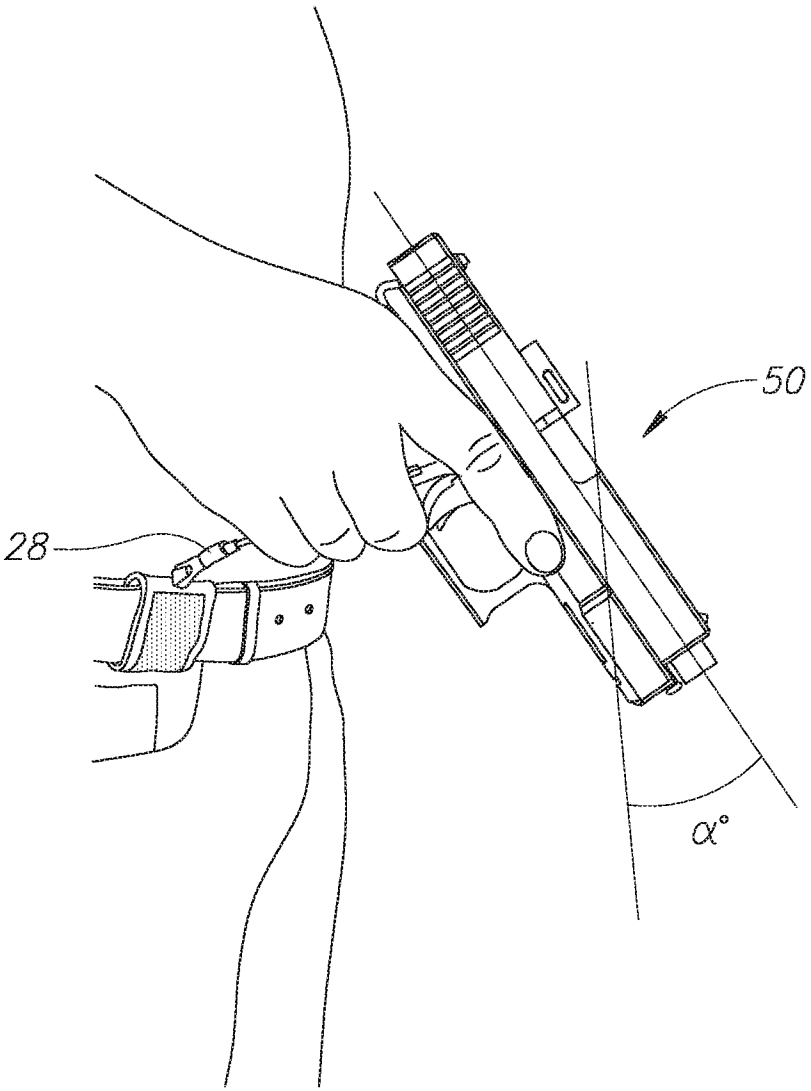
Figure 8C:
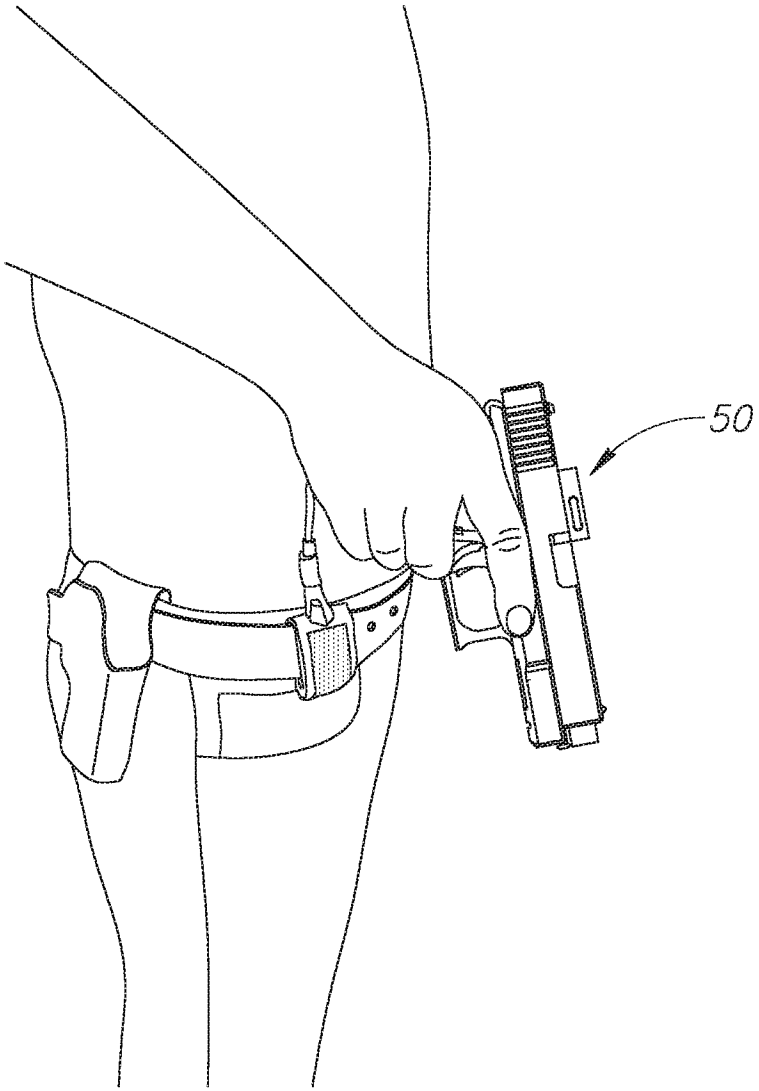
Figure 8F:
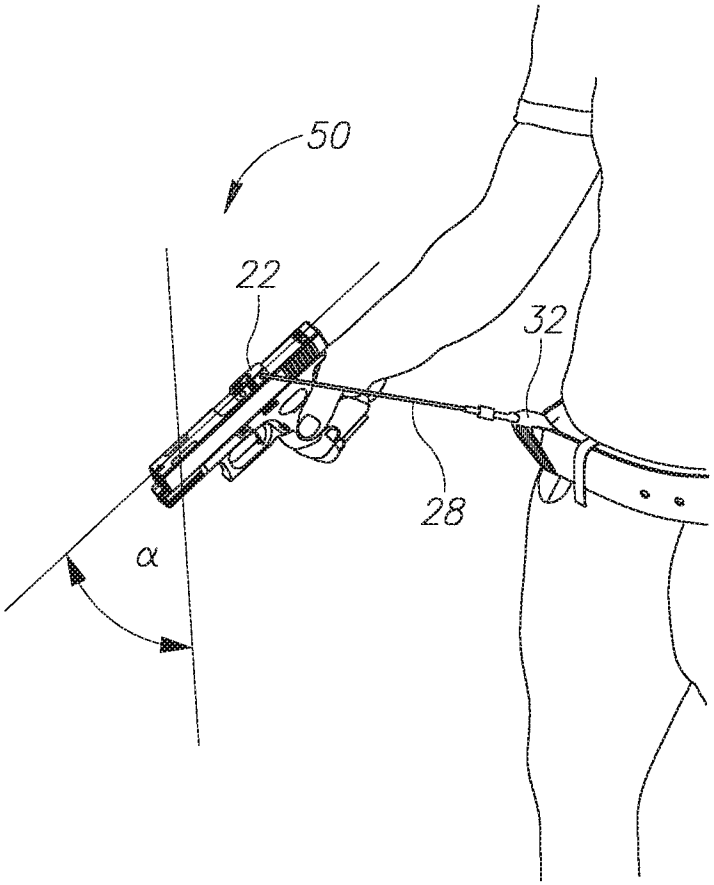
Figure 8E:
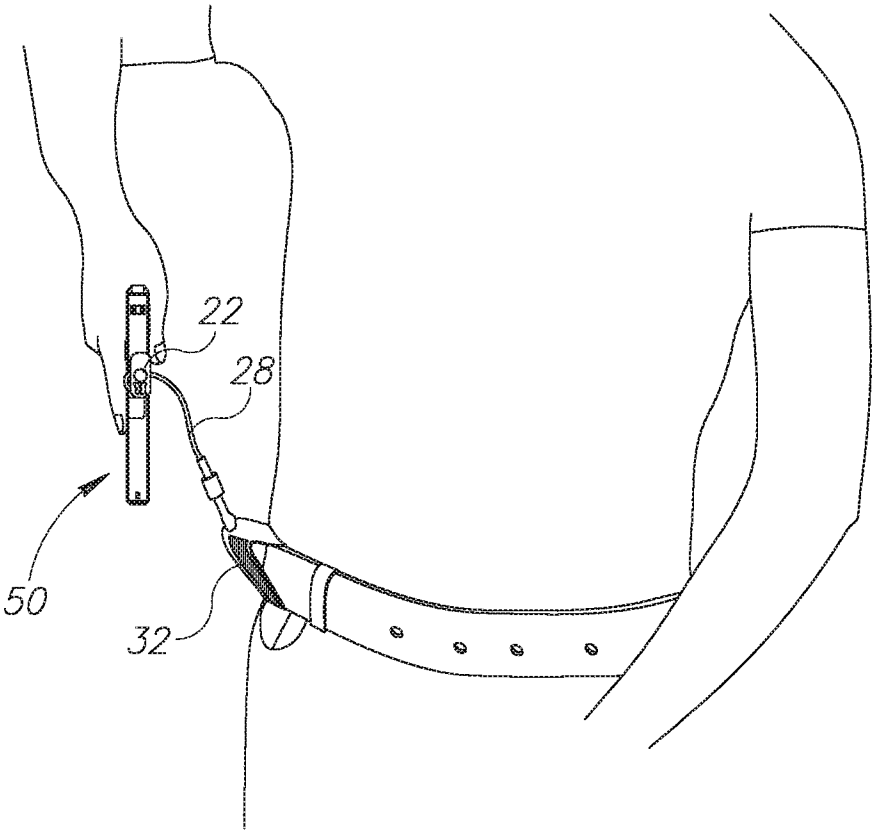
Figure 8G:
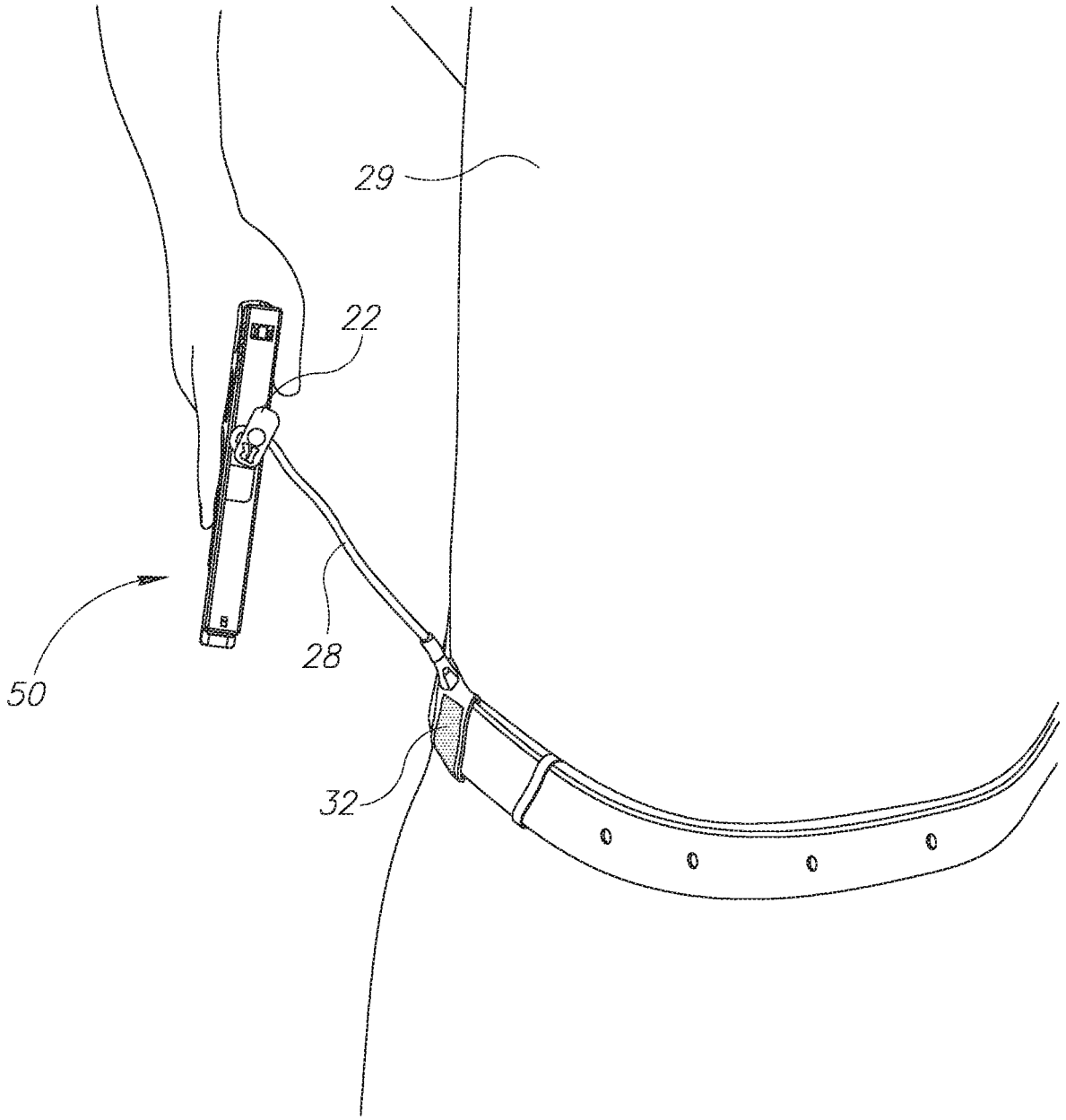
Figure 8I:
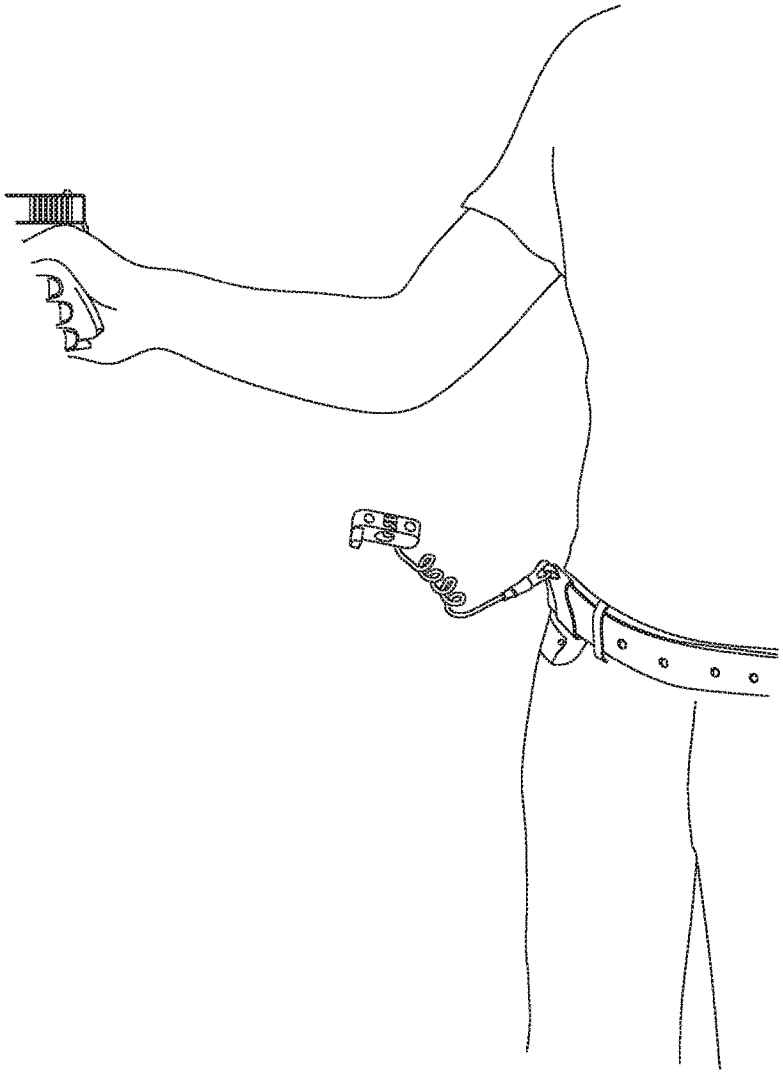
Figure 8H:
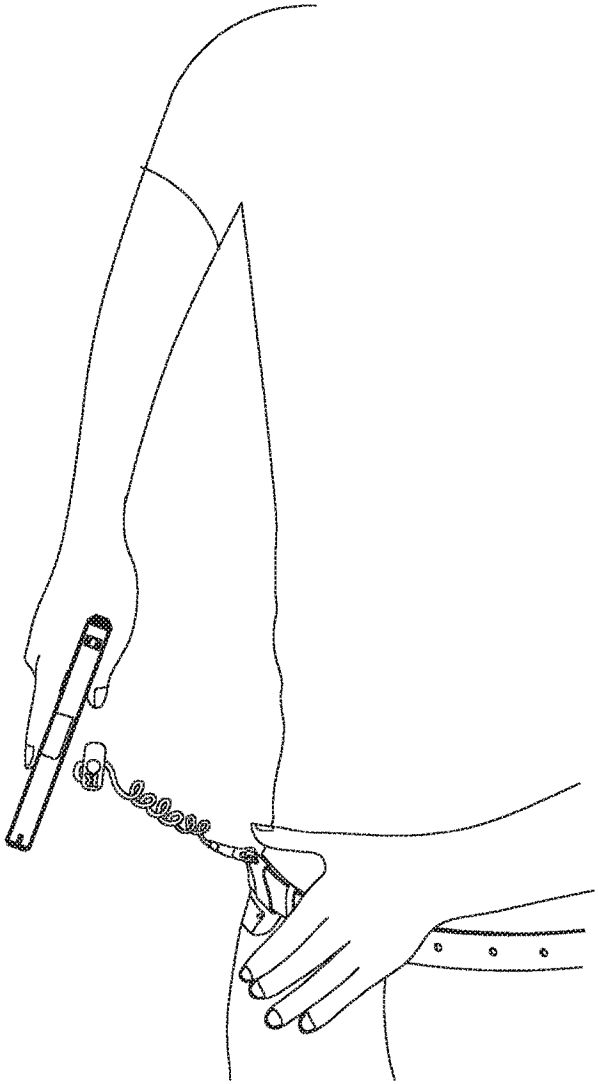

Then, the handgun 50 is safely introduced into the holster 103 as illustrated in FIGS. 8A and 8B, seeing that the safety element 22 remains in place at its interfering positon secured by the magnetic attracting force and slightly being clamped between the breech face and the rear face of the cartridge).

The firearm 50 is now cocked, with a live round of ammunition in the barrel chamber, and all that it takes for discharging a round is drawing the handgun from the holster 103 as illustrated in FIGS. 8A to 8I, illustrated consecutive steps of drawing and firing a round. In FIG. 8A the handgun is gripped by the user and is then pulled out of the holster (FIG. 8B), whilst the cord 28 is not yet at its full length position, i.e. is still loos. As the user continues the draw (FIGS. 8C-8E) the handgun 50 reaches an angle d of between about 10° to 55° (measured with respect to an imaginary vertical line), with the cord 28 reaching its predetermined full length (FIG. 8E), as a result of which the safety element 22 starts detaching from the handgun 50 (FIGS. 8F and 8G) until it completely detaches (FIGS. 8H and 8I) facilitating complete locking of the firing mechanism, whereby a round can be fired as the trigger is pulled.

It is thus noted that even at the event of early pulling the trigger, before reaching the safe zone (i.e. before the handgun is at a safe angle as mentioned before), the handgun will not discharge a round. However, the act of fast draw and firing a round is not obstructed or slowed down by the provision of the handgun safety device according to the disclosure. Thus, the application of the handgun safety device according to the disclosure can eliminate, or substantially reduce the self-accidents (in particular those caused by users at a fast draw procedure, often occurring when the handgun is pointed below the safe zone, i.e. as in the position of FIGS. 8B, 8C).

Also to be noted, the effective safe zone can be configured and altered depending on several parameters such as the length of the cord, elasticity and retraction force of the cord, strength of the attachment arrangement (e.g. magnetic attraction), location of the attaching member to the user (namely attached to a holster or to a belt at a location forward of the holster), etc. these parameters can be controlled and adjusted to comply with physiological parameters of the individual (the user) and safety requirements.

Figure 2A:
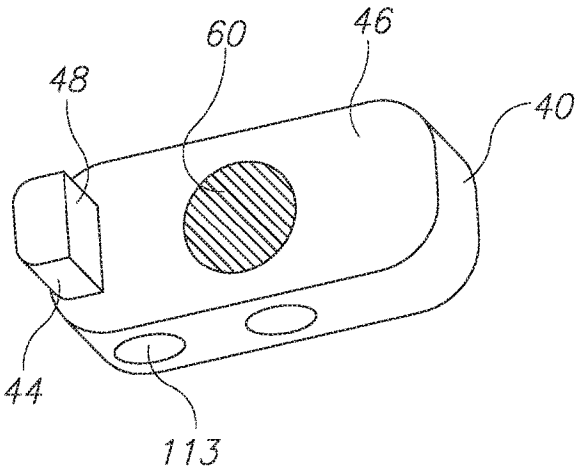

Furthermore, the safety element 22 can be attached to the first end of the cord at different configurations. In the example of FIGS. 1 and 2 the first end 24 of the cord 28 is secured to the housing (body portion 40) of the safety element 22 through an aperture 113 extending at an angle with respect to a longitudinal axis of the body portion 40, whereby it has a specific Left/Right orientation, suited for use by lefthand or righthand users, as may be the case. For easy identification, the safety element 22 is configured with indicia (letter R engraved), indicating it is configured for used by a righthand user. However, the body is ready made for either Left/Right cord articulation.

In addition, the body portion of the safety element can be colored at different colors, providing visible indicia e.g. at a training arena. For example, bright colors can indicate that the device is in use with a handgun loaded with live ammunition, etc. Furthermore, the body portion of the safety element can comprise a light emitting element, for providing different indications, e.g. the positioning of the device over the handgun, loaded handgun, etc.

The invention claimed is:

1. A handgun safety device, comprising:

a safety element with a firing interrupting element configured for snug projection between a face of a duty cartridge and a fore end of a functional firing element;

wherein said safety element is articulated at a first end of a cord having a full length, with a second end configured for attaching to an article worn by a user.

2. The handgun safety device according to claim 1, wherein as long as the firing interrupting element is disposed at an interrupting positon, between the face of the duty cartridge and the functional firing element, the firing interrupting element obstructs a firing mechanism of the handgun, so that a round cannot be fired even at the event that a trigger is pulled by the user.

3. The handgun safety device according to claim 1, wherein the second end of the cord is configured with a fixed or a detachable attaching member, for fixedly or removably attaching to the article worn by a user.

4. The handgun safety device according to claim 3, wherein the attaching member can be fixedly or detachably secured to the second end of the cord.

5. The handgun safety device according to claim 1, wherein the cord is configured to reach the full length upon drawing the handgun and reaching an angle of between about 15 to about 55 degrees, measured with respect to an imaginary vertical line.

6. The handgun safety device according to claim 1, wherein the full length of the cord is between about 20 to about 60 cm.

7. The handgun safety device according to claim 1, wherein the cord is associated with a cord retractor mechanism.

8. The handgun safety device according to claim 1, wherein the cord is articulated to the safety element at a location coaxial with longitudinal axis thereof.

9. The handgun safety device according to claim 1, wherein the cord is articulated to the safety element at a location offset from a longitudinal axis thereof.

10. The handgun safety device according to claim 1, wherein safety element is configurable for left-hand or right-hand users.

11. The handgun safety device according to claim 10, wherein the safety element comprises indicia representing weather the device is Left hand or right hand.

12. The handgun safety device according to claim 1, wherein safety element has an L-like cross section, where a long arm segment is configured for externally bearing over a portion of the handgun, and a short arm segment is the firing interrupting element.

13. The handgun safety device according to claim 1, wherein the length of the cord is adjusted for adapting the cord to various articles worn by the user and to physiological parameters of a user.

14. The handgun safety device according to claim 1, wherein the safety element further comprises an attachment arrangement for attaching the safety element to the handgun, however readily detachable.

15. The handgun safety device according to claim 1, wherein the attachment arrangement is a magnet.

16. A method for using a handgun, the method comprising:

(a) obtaining a handgun safety device comprising a safety element with a firing interrupting element configured for snug projection between a face of a duty cartridge and a fore end of a functional firing element, said safety element being articulated at a first end of a cord having a full length, with a second end configured for attaching to an article worn by a user;

(b) attaching the second end to an article worn by a user;

(c) before or after act (b) at least partially cocking the handgun so as to give rise to a space between the face of a duty cartridge and a fore end of a functional firing element;

(d) placing the safety element with the firing interrupting element at an interrupting positon; and (e) releasing the handgun from the at least partially cocked position.

17. The method according to claim 16, wherein at least partially cocking the handgun can be facilitated by cocking a slide of the handgun until the slide becomes arrested by a slide stop.

18. The method according to claim 16, wherein drawing the handgun when the safety element is positioned with the firing interrupting element at in interrupting positon and with the second end attached to the article worn by the user, results in extending of the cord to substantially the full length, with further motion resulting in detaching of the safety element from the handgun, thereby enabling full contact and complete locking of the fire mechanism of the handgun, such that pulling a trigger of the handgun will result in firing a round.

* * * * *